United States Patent [19]

Roberts

[11] Patent Number: 4,796,203

[45] Date of Patent: Jan. 3, 1989

[54] HIGH RESOLUTION MONITOR INTERFACE AND RELATED INTERFACING METHOD

[75] Inventor: Barry R. Roberts, Lindenhurst, Ill.

[73] Assignee: Kabushiki Kaisha Toshiba, Kanagawa, Japan

[21] Appl. No.: 900,591

[22] Filed: Aug. 26, 1986

[51] Int. Cl.[4] ..... G09G 1/02

[52] U.S. Cl. ..... 364/521; 340/750; 340/798

[58] Field of Search ..... 364/518–522; 340/703, 750, 798–800

[56] References Cited

U.S. PATENT DOCUMENTS

| | | | |
|---|---|---|---|
| 4,485,378 | 11/1984 | Matsui et al. | 340/798 X |
| 4,604,615 | 8/1986 | Funahashi | 340/799 X |
| 4,661,812 | 4/1987 | Ikeda | 340/798 X |
| 4,677,427 | 6/1987 | Komatsu et al. | 340/703 |
| 4,688,032 | 8/1987 | Saito et al. | 340/799 |

*Primary Examiner*—Gary V. Harkcom
*Assistant Examiner*—H. R. Herndon
*Attorney, Agent, or Firm*—Finnegan, Henderson, Farabow, Garrett, & Dunner

[57] ABSTRACT

An interface, between a display monitor and a source of image information for display as pixels at display locations of the monitor, the interface comprising: a monitor input terminal for receipt of image information for display on the monitor; a refresh memory for storing image information at memory locations corresponding to the display locations of the monitor; a device for sequentially reading the image information from the memory locations of the refresh memory to the monitor input terminal for display at the corresponding display locations of the monitor; a device for storing new image information for one of the memory locations of the refresh memory; and a device for replacing sequential reading of the image information from said refresh memory at the one of the memory locations with: (i) reading of new image information from the new information store to the monitor input terminal for display of the new image information at the discrete display location of the monitor corresponding to the one of the memory locations, and (ii) writing the new image information from the new information store to the one of the memory location of the refresh memory. A related method is also provided.

13 Claims, 1 Drawing Sheet

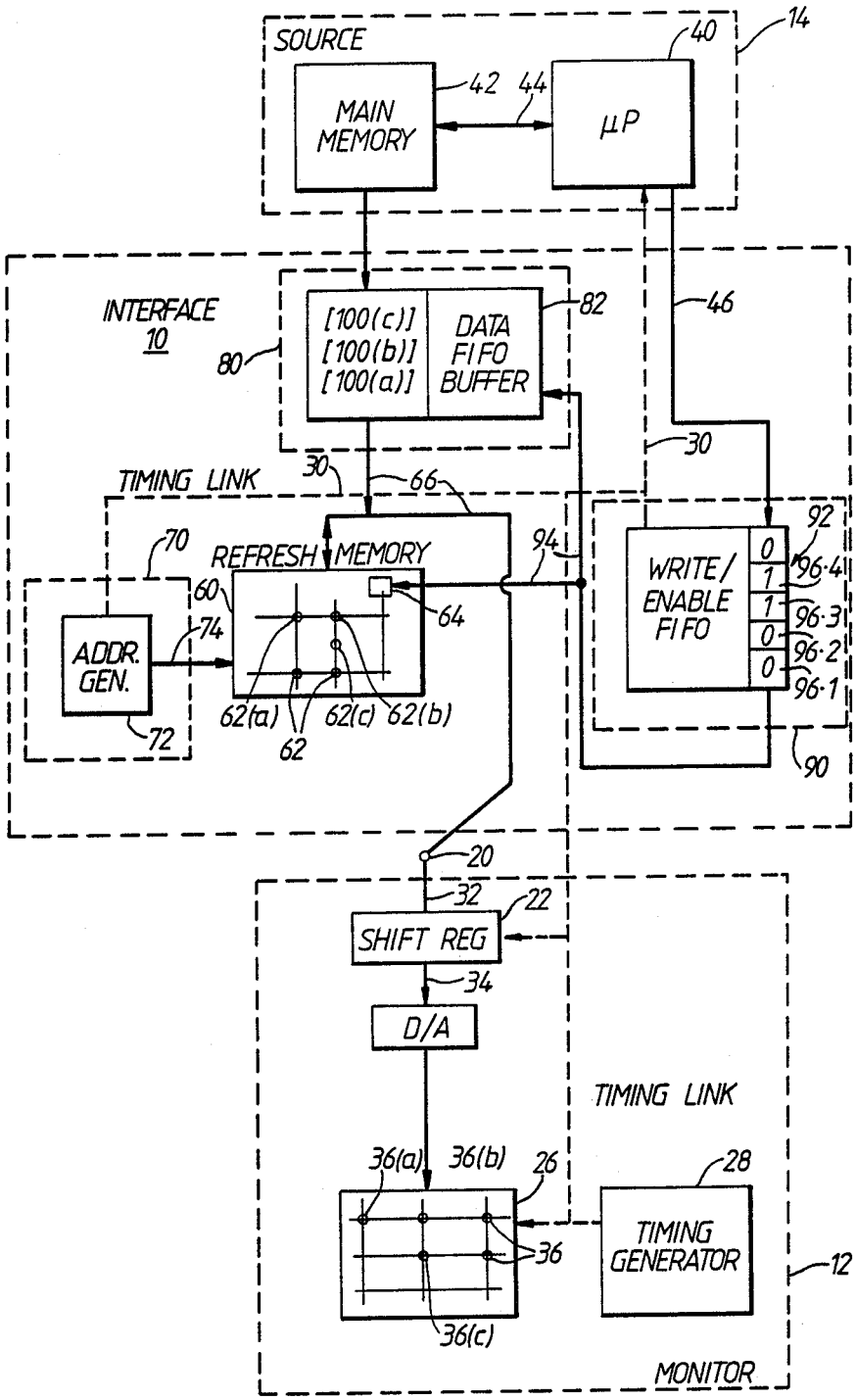
SOURCE
MAIN MEMORY
μP
14
40
42
44
INTERFACE 10
[100(c)]
[100(b)]
[100(a)]
DATA FIFO BUFFER
82
80
46
30
TIMING LINK
66
REFRESH MEMORY
60
64
70
ADDR. GEN.
74
72
62(a)
62(c)
62(b)
62
94
WRITE/ ENABLE FIFO
92
0
1
1
0
0
96·4
96·3
96·2
96·1
90
20
32
22
SHIFT REG
34
D/A
TIMING LINK
36(a)
36(b)
26
28
TIMING GENERATOR
36
36(c)
12
MONITOR

HIGH RESOLUTION MONITOR INTERFACE AND RELATED INTERFACING METHOD

BACKGROUND OF THE INVENTION

I. Field of the Invention

This invention relates generally to a high resolution display monitor interface and related interfacing method, and more specifically to an interface and related interfacing method for communicating updated image information from a source of that image information to a monitor input terminal of a high resolution monitor.

II. Background Information

A high resolution monitor interface typically includes a data buffer, a refresh memory, a monitor input terminal, a bus linking the data buffer and the refresh memory, and a bus linking the refresh memory and the monitor input terminal. The data buffer and refresh memory both store information indicative of images to be displayed on a monitor at particular discrete display locations of the monitor. The data buffer stores selective new image information. The refresh memory stores a complete set of image information. The existence of new image information for the data buffer indicates that the image presently being displayed on the monitor from image information stored in the refresh memory requires updating.

The new image information is retained by the data buffer until this new image information can be transferred to the refresh memory. In a typical system, only at specific time periods is the refresh memory available to receive new image information from the data buffer. The refresh memory is available to receive new image information only when not being used to refresh the monitor image.

The refresh memory stores digital image information for every discrete display location of the monitor. The monitor, which retains an image for only a finite period of time, uses the image information stored in the refresh memory and periodically transferred to the monitor input terminal, to retrace the monitor image. The monitor image is presented in lines of picture elements or pixels. The monitor has an electron beam which is modulated by image information supplied to the monitor input terminal to scan and thereby refresh each pixel across a line. After completion of a line scan, the electron beam returns to the beginning of a subsequent scan line to begin refreshing each pixel in that subsequent line. After completion of the last line of each scan, the electron beam returns to the top of the scan. The time taken for the electron beam to return to the beginning of a subsequent line from the last pixel of the previous line (horizontal "flyback") or to the top of the scan after completion of the last scan line (vertical "flyback") is very short. In that brief time, the refresh memory is not being used to refresh the monitor, that is, to transfer image information to the monitor input terminal, and is available then to receive new image information from the data buffer.

While the electron beam is returning to begin another line, that is, in the periods referred to as horizontal or vertical "flyback", the data buffer which is connected by a bus to the refresh memory is enabled to read the new image information stored in the data buffer to the refresh memory, and the refresh memory is correspondingly enabled to write the new image information from the data buffer into the refresh memory.

If the monitor is a high resolution monitor, the amount of image information required to update any part of the monitor image may be quite large and the flyback periods quite small. In the brief time of "flyback" when the data buffer is enabled to read and the refresh memory is enabled to write, as much of the new image information as time permits is transferred to the refresh memory. More information can be transferred to the refresh memory if the data buffer and the refresh memory have high bandwidths, that is, can write and read many parallel bits of information simultaneously. If the bandwidth is low, not much information is passed during "flyback". Even if the bandwidth is high, because the new image information can only be passed to the refresh memory during "flyback" the amount of information that can be passed is severely limited. Hence, very many flyback periods are required to transfer significant amounts of new image information. As a consequence, the new image is "painted" on the monitor.

Another method of updating the monitor is to disrupt the scanning processes and transfer new image data to the refresh memory buffer in one burst. The effect of this process is to interrupt the viewed image and cause a visual flicker.

Thus, the present form of interfacing makes difficult any solution to the above-described problems of slow painted or flickered updating of the monitor image. The dilemma set forth above becomes more acute with high resolution interfaces which need to transfer more image information than do typical interfaces in order to fully update a monitor image.

Accordingly, an object of the present invention is to provide a monitor interface and related method having a refresh memory which may more effectively receive new image information from a data buffer than in prior systems.

An additional object is to provide an interface and related method which can achieve "flickerless" update at monitor frame rates.

A still further object of the present invention is to provide an improved interface and related method for a high resolution monitor.

Additional objects add advantages of the invention will be set forth in the description which follows, and in part will be obvious from the description or may be learned by practice of the invention.

SUMMARY OF THE INVENTION

To achieve the foregoing objects, and in accordance with the purpose of the invention as embodied and broadly described herein, there is provided an interface, between a display monitor and a source of image information, for permitting display of that image information at corresponding display locations of the monitor, the interface comprising: a monitor input terminal for receipt of image information for display on the monitor; a refresh memory for storing image information at memory locations corresponding to the display locations of the monitor; first means for sequentially reading the image information from the memory locations of the refresh memory to the monitor input terminal for display at corresponding display locations of the monitor; second means, coupled to the source of image information, for storing new image information for one of the memory locations of the refresh memory; and third means for replacing sequential reading by the first means of the image information from the refresh memory at the one of the memory locations to the monitor input with: (i) reading of the new image information from the second means to the monitor input terminal for display of the new image information at at least one display location of the monitor corresponding to the one of the discrete memory locations and (ii) writing of the new image information from the second means into that one of the memory locations of the refresh memory.

Preferably, the first means for sequentially reading the image information comprises: address generator means for sequentially generating addresses which are operative to select image information at memory locations of the refresh memory for display at corresponding display locations of the monitor.

It is further preferable that the third means comprise a write/enable FIFO register and that the refresh memory includes a write/enable input terminal for receiving a write signal from the write/enable FIFO register to enable new image information from the second means to be written into the refresh memory.

The method of the subject invention, for interfacing a monitor and a source of image information to permit display of that image information at corresponding display locations of the monitor, comprises the steps of: (a) storing image information in a refresh memory at memory locations corresponding to display locations on the monitor; (b) reading image information sequentially from the memory locations of the refresh memory to a monitor input terminal for display at the corresponding display locations of the monitor; (c) storing new image information for one of the memory locations of the refresh memory in a data buffer coupled to the source of the image information; (d) replacing the step of reading image information sequentially from the refresh memory at the one of the memory locations to the monitor input terminal with the steps of: (i) reading new image information from the data buffer to the monitor input terminal for display of that new image information at at least one display location of the monitor corresponding to the one of the discrete memory locations, and (ii) writing the new image information from the data buffer into that one of the memory locations of the refresh memory.

BRIEF DESCRIPTION OF THE DRAWING

The FIGURE is a block diagram of a monitor interface incorporating the teachings of the subject invention.

DESCRIPTION OF THE PREFERRED EMBODIMENT

Referring to the FIGURE, an interface 10 incorporating the teachings of the subject invention is shown connected between a monitor 12 and a source of image information 14. Monitor 12 is illustrated in the FIGURE as comprising a monitor input terminal 20, a shift register 22, a digital-to-analog converte 24, and a display CRT 26, a timing generator 28 and a timing link 30. Monitor input terminal 20 is connected by a bus 32 to the input of shift register 22. The output of shift register 22 is connected by a bus 34 to the input of digital-to-analog converter 24. The output of digital-to-analog converter 24 is connected to the input of CRT 26. The face of CRT 26 may be considered as being divided into a plurality of discrete locations 36 at which individual pixels of image information may be displayed, as is well known to those skilled in the art. Timing generator 28 is coupled by timing link 30 to CRT 26 and shift register 22 to control the timing of those devices as should be apparent to those skilled in the art.

A source of image information 14 is illustrated in the FIGURE as comprising a microprocessor 40 and a main memory 42. Microprocessor 40 is connected to main memory 42 by a data bus 44. Microprocessor 40 is also coupled to interface 10 by a data link 46 and to timing generator 28 by timing link 30. Main memory 42 is coupled to interface 10 by a memory bus 50.

Interface 10 is illustrated in the FIGURE as comprising a refresh memory 60, a first circuit 70, a second circuit 80, and a third circuit 90. Refresh memory 60 is illustrated as comprising a plurality of discrete memory locations 62 whose locations are each identified by corresponding memory addresses. Image information may be stored at the memory locations 62 for display at corresponding monitor locations 36 of CRT 26. Refresh memory 60 also has a write/enable terminal 64. In addition, a bus 66 is connected from an output of second circuit 80 to both a data input/output of refresh memory 60 and monitor input terminal 20. Bus 66 is preferably 128 bits wide. It is also preferable that each memory location 62 is capable of storing a 128 bit word and that shift register 22 of monitor 12 converts each 128 bit word to sixteen (16) 8 bit words. Thus, the image information stored in each memory location 62, in the preferred embodiment of the FIGURE, actually corresponds to pixel displays at a plurality (sixteen) of corresponding monitor locations 36.

First circuit 70 comprises an address generator 72. Timing link 30 from timing generator 28 is coupled to an input of address generator 72, and an output of address generator 72 is connected by line 74 to an address input of refresh memory 60. As will be explained in more detail below, first circuit 70 operates to sequentially address image information in memory locations 62 of refresh memory 60 and to supply that image information over bus 66 to monitor input terminal 20 for subsequent display at corresponding discrete memory locations 36 of CRT 26 of monitor 12.

Second circuit 80 is a data buffer comprising a data first-in-first-out (FIFO) buffer 82. An input data terminal of buffer 82 is connected to the output of main memory 42 by memory bus 50, while a data output of buffer 82 is coupled by bus 66 both to the data input/output of refresh memory 60, as explained above, and also to monitor input terminal 20. Buffer 82 preferably is capable of stacking a plurality of 128 bit words and delivering those words one at a time to refresh memory 60 and monitor input terminal 20. Thus, second circuit 80 is coupled to source of image information 14 and operates, as will be explained below, to store new image information for discrete memory locations 62 of refresh memory 60 which contain image information that is next to be updated.

Third circuit 90, in the preferred embodiment illustrated in the FIGURE, comprises a write/enable FIFO 92. Input control information is delivered from microprocessor 40 over data link 46 to write/enable FIFO 92. This input control information is subsequently delivered from write/enable FIFO 92, over line 94, both to a control input of data buffer 82 and to write/enable terminal 64 of refresh memory 60. Write/enable FIFO 92 is also coupled by timing link 30 to timing generator 28. As will be explained in more detail below, third circuit 90 operates to replace sequential reading of image information from refresh memory 60 for a particular discrete memory location 62 which is next to be updated with two different functions; namely, reading of new update image information from data buffer 82 of second circuit 80 to monitor input terminal 20 for display of that new information at the discrete display locations 36 of CRT 26 of monitor 12 corresponding to the next to be updated discrete memory location 62 for which the replacement operation is undertaken. In addition, third circuit 90 replaces the aforementioned sequential reading of the next to be updated discrete memory location 62 with writing of the new image information from data buffer 82 of second circuit 80 into that discrete memory location of refresh memory 60.

In operation of interface 10 illustrated in the FIGURE, image information is stored in discrete memory locations 62 of refresh memory 60. This image information may be initially loaded into refresh memory 60 in any conventional manner, or may be loaded into refresh memory 60 in accordance with the refresh operation of the subject invention as will be described below. In any event, for purposes of illustration, an assumption is made that, preliminarily, appropriate image information is stored in discrete locations 62 of refresh memory 60 for display as pixels of corresponding discrete monitor locations 36 of monitor 12.

Under normal operation, without any need to update the image information stored at memory locations 62, that image information is sequentially read out from refresh memory 60 uneer operation of address generator 72. The sequentially read out image information is delivered over bus 66 to monitor input terminal 20 and, thus, is delivered to the input of shift register 22 of monitor 12. Shift register 22 takes each 128 bit word of image information from refresh memory 60 and delivers that information in smaller segments, such as in 8-bit word segments, over line 34 to digital-to-analog converter 24 where the segmented image information is converted to analog signals and subsequently displayed as pixels at corresponding display locations 36 of CRT 26. Timing generator 28 provides synchronous operation between address generator 72 and monitor 12 through delivery of appropriate timing signals, for example over timing link 30.

Thus, under normal non-updating operation, there is a sequential read out of image information from refresh memory 60 and subsequent display of that information at corresponding monitor locations 36.

In accordance with the present invention, a mechanism is provided for both displaying new image information and storing that new image information. As illustratively shown in the FIGURE second circuit 80 includes buffer 82 which is capable of receiving in sequential order new image information from main memory 42 over memory bus 50. This new image information is stored in a stacked manner in buffer 82 with the oldest of the new information being delivered from buffer 82 to refresh memory 60 in sequential order, under control of write/enable FIFO 92.

For purposes of illustration, assume that the image information at display locations **36*a*, 36*b* and 36*c* of monitor 12 is to be updated with new image information 100*a*, 100*b* and 100*c*, respectively. As should be apparent to those skilled in the art, if the image information at a particular discrete memory location 62 of refresh memory 60 is 128 bits long and, therefore, contains image information for a plurality of display locations 36, the correspondence between image information at any particular memory location 62 and a corresponding discrete display location 36 is not a one-to-one correspondence but may, instead, be a 16-to-one correspondence or some other ratio. Thus, for purposes of this invention, the term "corresponding," in the context of the relationship between the image information stored in refresh memory 60 and the display of that information at memory locations 36 of monitor 12 is to be broadly interpreted. As a consequence, each display location 36*a*, 36*b* and 36*c* should be considered to comprise display of sixteen (16) pixels, given a 16 to 1 conversion by shift register 22**.

At the beginning of each vertical flyback of CRT 62, address generator 72 is recycled through operation of timing generator 28 to renew sequential accessing of the addresses of refresh memory 60. Assume that memory location **62*a* is, for example, at the third address of refresh memory 60, memory location 62*b* is at the fourth address and memory location 62*c* is at the two hundredth address, with memory locations 62*a*, 62*b* and 62*c* corresponding to the display locations 36*a*, 36*b* and 36*c* and being the memory locations where new image information 100*a*, 100*b* and 100*c* are to be stored. Given this assumption, microprocessor 40 operates to put a string of control data into write/enable FIFO 92, which control data corresponds to the intended locations of the new image information 100*a*, 100*b* and 100*c* in refresh memory 60. Specifically, since the image information at the first sequential address of refresh memory 60 is not to be updated, microprocessor 40 delivers over control link 46 a zero to the first storage register 96-1 of write/enable FIFO 92. Given the example set forth above, the image information at the second sequential address of refresh memory 60 is also not to be updated and, therefore, a zero is also loaded by microprocessor 40 into the second register 96-2 of write/enable FIFO 92. However, given the above example, memory location 62*a* is to be updated with new image information 100*a* and memory location 62*a* is located at the third sequential address of refresh memory 60. Accordingly, a 1 bit is loaded by microprocessor 40 into the corresponding third register 96-3 of write/enable FIFO 92. If, for example, new image information 100*b* is to be loaded into memory location 62*b* of refresh memory 60 and memory location 62*b* is at the fourth consecutive address of refresh memory 60, a 1 bit would also be loaded by microprocessor 40 into the corresponding fourth register 96-4 of write/enable FIFO 92. Thus, write/enable FIFO 92 contains a stack of control bits which corresponds to the sequential addresses of refresh memory 60 which in turn correspond to memory locations 62 of refresh memory 60, with a zero bit contained in that stack for each memory location 62 which is not to be updated and a 1 bit contained in that stack for each corresponding memory location 62** which is to be updated.

Given the above example, in operation the first address from address generator 72 of a new scan is delivered over line 74 to refresh memory 60 at the same time a corresponding zero bit from register 96-1 of write/enable FIFO 92 is delivered over line 94 to write/enable terminal 64, setting refresh memory 60 into a read mode and thereby allowing the image information from the memory location 62 of the first address to be read out of refresh memory 60 over bus 66 to monitor input terminal 20, from where that image information is subsequently divided from 128 bits in shift register 22 to sixteen 8 bit words with the resultant sixteen 8 bit words delivered to digital-to-analog converter 24 where they are subsequently employed to display pixels at a corresponding display location 36 of monitor 12. The next address provided by address generator 72 likewise accesses the image information from the corresponding next memory location 62 of refresh memory 60, since a corresponding zero bit from register 96-1 of write/enable FIFO 92 has been shifted to register 96-2 and, therefore, enables refresh memory 60 to again operate in the read mode.

However, in the example given above, the third address from address generator 72 corresponds to memory location 62*a*, for which new image information 100*a* has been provided by microprocessor 40 to data buffer 82. For this third address, the 1 bit initially in register 96-3 of write/enable FIFO 92 has been shifted to the first register 96-1 and delivered by line 94 both to data buffer 82 and to write/enable terminal 64 of refresh memory 60. This 1 bit converts refresh memory 60 from a read to a write mode and simultaneously releases data buffer 82 to permit delivery of new image information 100*a* from data buffer 82 over bus 66 to the input/output terminal of refresh memory 60 and to monitor input terminal 20. Thus, for the memory location 62*a* corresponding to the third address of refresh memory 60, new image information is delivered to monitor 20 from data buffer 82 instead of from refresh memory 60, and this same new image information from data buffer 82 is written into memory location 62*a* of refresh memory 60 due to simultaneous activation of refresh memory 60 to the write mode by operation of write/enable FIFO 92.

Thus, new image information 100*a* is available for updating of the display of monitor 12 and simultaneous updating of refresh memory 60 without any delay in the operation of monitor 12. This permits real time flickerless display of new image information on high resolution monitor 12.

Subsequent new image information 100*b* is then loaded into data buffer 82 by operation of microprocessor 40 and is available for simultaneous delivery to refresh memory 60 and monitor input terminal 20 when address generator 72 reaches the address corresponding to the location of that new image information 100*b*. In the example given above, this location is the fourth address for address generator 72 and, as a consequence, the 1 bit initially in register 96-4 of write/enable FIFO 92 is available in register 96-1 to continue to keep refresh memory 60 in a write mode upon receipt of the fourth address from address generator 72. Accordingly, new image information 100*b* is also simultaneously written into refresh memory 60 at memory location 62*b* and is available for use at monitor input terminal 20 for display at the corresponding display location 36*b* of CRT 26. The term "simultaneously" as used in this context, refers to an essentially simultaneous operation in that the operation of reading image information from refresh memory 60 is replaced with the dual operation of writing new image information from data buffer 82 into the corresponding location of refresh memory 60 and delivering that same information to monitor 12 for display on CRT 26.

It should be understood that the apparatus illustrated in the FIGURE is merely illustrative of the teachings of the subject invention. Thus, refresh memory 60, first circuit 70, second circuit 80 and third circuit 90 may take on different specific forms other than those illustratively disclosed with regard to interface 10 of the FIGURE, and yet fully incorporate the teachings of the subject invention.

In view of the foregoing, it should be understood that in addition to disclosure of a high resolution monitor interface, a related method has also been disclosed for interfacing a source of image information and a monitor. This method, in its generic form, may be said to comprise the steps of: (a) storing image information in a refresh memory at memory locations corresponding to display locations on the monitor; (b) reading that image information sequentially from the memory locations of the refresh memory to a monitor input terminal for display at the corresponding display locations of the monitor, using a first means; (c) storing new image information for one of the memory locations of the refresh memory in a second means coupled to the source of image information; and (d) replacing the step of reading the image information sequentially from the refresh memory at the one of the memory locations to the monitor input terminal, with the steps of: (i) reading the new image information from the second means to the monitor input terminal for display of the new image information at at least one display location of the monitor corresponding to the one of the memory locations, and (ii) writing the new image information from the second means to the one of the discrete memory locations of the refresh memory.

Thus, the interfacing scheme of the subject invention does not require transfer of image information to the refresh memory before that image information is transferred to the monitor input terminal. Image information is transferred to the monitor input terminal directly whenever new image information is being used to update the refresh memory. This scheme is particularly useful in high resolution interfaces with large amounts of image information that would ordinarily experience delayed transfer to the monitor input terminal, awaiting first transfer to the refresh memory in the time when sequential reading is halted for this purpose.

It should be apparent to those skilled in the art that various modifications may be made to the monitor interface and related method of the subject invention without departing from the scope or spirit of the invention. Thus, it is intended that the invention cover modifications and variations of the invention, provided they come within the scope of the appended claims and their legally entitled equivalents.

I claim:

1. An interface, between a display monitor and a source of image information, for permitting display of that image information at corresponding display locations of said monitor, said interface comprising:

(a) a monitor input terminal for receipt of image information for display on said monitor;

(b) a refresh memory for storing image information at memory locations corresponding to said display locations of said monitor;

(c) first means for sequentially reading said image information from said memory locations of said refresh memory to said monitor input terminal for display at said corresponding display locations of said monitor;

(d) second means, coupled to said source of image information, for storing new image information for one of said memory locations of said refresh memory; and (e) third means for replacing sequential reading of said image information by said first means from said refresh memory at said one of said memory locations to said monitor input terminal with:

(i) reading said new image information from said second means to said monitor input terminal for display of said new image information at at least one display location of said monitor corresponding to said one of said memory locations, and (ii) writing said new image information from said second means into said one of said memory locations of said refresh memory, said writing of said new image information being simultaneous with said reading of said new image information for display.

2. An interface of claim 1 wherein said first means for sequentially reading said image information comprises:

(a) address generator means for sequentially generating addresses, each of said addresses being operative to select image information at one of said memory locations of said refresh memory for display at said corresponding display locations of said monitor; and (b) a bus, linking said refresh memory with said monitor input terminal, for transferring said image information from said refresh memory to said monitor input terminal.

3. An interface of claim 1 wherein said refresh memory comprises a write/enable input terminal for receiving a write signal which enables said refresh memory to be in a condition to write said new image information into said one of said memory locations of said refresh memory.

4. An interface of claim 3 wherein said third means for replacing sequential reading comprises write/enable means, coupled to said write/enable input terminal of said refresh memory, for enabling said refresh memory to be in said condition to write said new image information to said one of said memory locations of said refresh memory.

5. An interface of claim 3 wherein said third means for replacing sequential reading comprises write/enable means, coupled between said source of image information and said write/enable input terminal of said refresh memory, for receiving control data from said source corresponding to said one of said memory locations of said refresh memory to be written with said new image information, said control data acts to enable said refresh memory to be in said condition to write said new image information to said one of said memory locations of said refresh memory.

6. An interface of claim 1 wherein said image information is digital in form.

7. An interface of claim 6 further including a digital-to-analog signal converter coupled between said monitor input terminal and said display monitor, to convert said digital image information received at said monitor input terminal to image information in analog form for use by said display monitor.

8. An interface of claim 7 further including a shift register coupled between said monitor input terminal and said digital-to-analog signal converter to convert said image information received at said monitor input terminal into a digital form suitable for use by said digital-to-analog signal converter.

9. An interfacing method, for interfacing a monitor and a source of image information, to permit display of that image information at corresponding display locations of said monitor, comprising the steps of:

(a) storing image information in a refresh memory at memory locations corresponding to display locations of said monitor;

(b) reading said image information sequentially from said memory locations of said refresh memory to a monitor input terminal for display at said corresponding display locations of said monitor, using a first means;

(c) storing new image information for one of said memory locations of said refresh memory in a second means coupled to said source of image information; and (d) replacing said step of reading said image information sequentially from said refresh memory at said one of said memory locations to said monitor input terminal, with the steps of:

(i) reading said new image information from said second means to said monitor input terminal for display of said new image information at at least one display location of said monitor corresponding to said one of said memory locations, and (ii) writing said new image information from said second means to said one of said memory locations of said refresh memory, said step of writing said new image information occurring simultaneously with said step of reading said new image information.

10. An interfacing method of claim 9 wherein said step of sequentially reading said image information comprises the substeps of:

(a) generating addresses sequentially using said first means, said addresses being operative to select image information at said memory locations of said refresh memory for display at said corresponding display locations of said monitor; and (b) transferring said image information selected by said addresses from said refresh memory to said monitor input terminal using a bus linking said refresh memory to said monitor input terminal.

11. An interface method of claim 9 wherein said step of replacing said step of reading sequentially comprises the step of setting a write/enable, input terminal of said refresh memory to enable said refresh memory to write new image information from said second means into a memory location of said refresh memory.

12. An interface method of claim 9 wherein said step of sequentially reading said image information comprises reading said image information in digitized form.

13. An interfacing method of claim 12 wherein said step of sequentially reading said image information is followed by the steps of:

(a) transferring said image information in digitized form to a shift register;

(b) converting said image information in digitized form to analog form using a digital-to-analog signal converter; and (c) transferring said image information in analog form to said monitor.

* * * * *